United States Patent [19]

Herdin et al.

[11] 4,335,686

[45] Jun. 22, 1982

[54] VALVE CONTROL AND PUMP-ACTUATING MEANS OF INTERNAL COMBUSTION ENGINE WITH FUEL INJECTION

[75] Inventors: Günther Herdin; Erhard Kauer, both of Steyr; Maximilian Muckenhuber, Behamberg; Eugen Egger, Steyr, all of Austria

[73] Assignee: Steyr-Daimler-Puch Aktiengesellschaft, Vienna, Austria

[21] Appl. No.: 101,219

[22] Filed: Dec. 7, 1979

[30] Foreign Application Priority Data

Dec. 19, 1978 [AT] Austria ..... 9057/78

[51] Int. Cl.[3] ..... F01L 1/08

[52] U.S. Cl. ..... 123/90.6; 123/90.27

[58] Field of Search ..... 123/90.17, 90.18, 90.27, 123/90.31, 90.48, 90.6, 90.1; 74/567; 239/88, 95, 584

[56] References Cited

U.S. PATENT DOCUMENTS

| | | | |
|---|---|---|---|
| 1,289,498 | 12/1918 | McHarry | 123/90.17 |
| 2,054,928 | 9/1936 | Church | 123/90.27 |
| 3,142,996 | 8/1964 | Anderson | 123/90.6 |

FOREIGN PATENT DOCUMENTS

| | | | |
|---|---|---|---|
| 966708 | 9/1957 | Fed. Rep. of Germany . | |
| 1141492 | 12/1962 | Fed. Rep. of Germany . | |
| 1165339 | 3/1964 | Fed. Rep. of Germany | 123/90.18 |
| 2436667 | 3/1976 | Fed. Rep. of Germany . | |
| 1087533 | 2/1955 | France . | |

*Primary Examiner*—Craig R. Feinberg
*Assistant Examiner*—W. R. Wolfe
*Attorney, Agent, or Firm*—Kurt Kelman

[57] ABSTRACT

An inlet valve, an outlet valve and a pump cam are formed on a camshaft. The pump cam is disposed between and axially spaced from the inlet and outlet valve cams. An inlet valve tappet and an outlet valve tappet have end faces engaging said inlet and outlet valve cams, respectively. A cam follower is operable by the pump cam to control a fuel injection pump. A plane which is normal to the axis of said camshaft and defines the axial extent of said pump cam toward one of said tappets intersects said end face of said one tappet to define a line of intersection, whereby said pump has an overlapping portion, which axially overlaps said one tappet, and the axial projection of the periphery of said overlapping portion lies entirely within an envelope which is generated by said line of intersection around said pump cam as said camshaft is rotated.

3 Claims, 7 Drawing Figures

Figure 1:
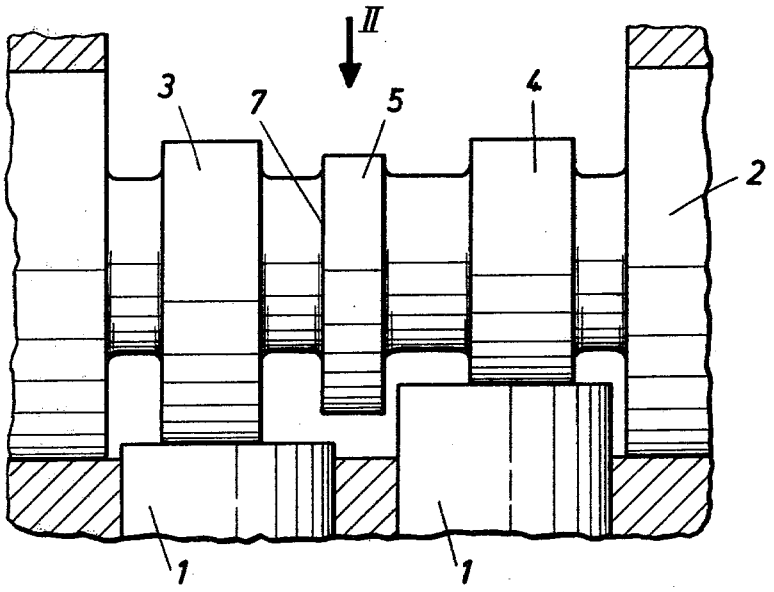

VALVE CONTROL AND PUMP-ACTUATING MEANS OF INTERNAL COMBUSTION ENGINE WITH FUEL INJECTION

This invention relates generally to internal combustion engines with fuel injection, hereinafter called fuel-injected engines, in which a fuel injection unit comprising a pump and a nozzle is associated with each cylinder and a camshaft is provided with valve cams for cylinder inlet and outlet valves, which are provided with flat-end tappets, and with pump cams for actuating respective pumps.

In known designs, the valve tappets of the inlet and outlet valves of a cylinder are spaced a relatively large distance apart so that the pump cam can easily be accommodated between the valve tappets. In order to reduce the size and weight of the engine, it is desired to reduce the spacing of the valve tappets. Besides, wide valve tappets are required in order to avoid the application of excessive pressures to the tappets at high speeds of the engine. The much higher fuel injection pressures require wider pump cams. For this reason it is an object of the invention to provide a camshaft which has wider cams and permits the valve tappets to be more closely spaced.

This object is accomplished according to the invention in that each pump cam axially overlaps at least one of the adjacent valve tappets and at least in its overlapping portion has a counter which lies within an envelope which is generated during the rotation of the camshaft by the line of intersection between the end face of the valve tappet and that pump cam-defining surface which is normal to the axis of the camshaft.

Because the pump cam axially overlaps at least one of the adjacent valve tappets, sufficiently wide pump cams can easily be accommodated even though the valve tappets are closely spaced apart. The overlap does not involve a collison between the pump cam and the valve tappet because the contour of the pump cam in its overlapping portion lies within the envelope defined hereinbefore.

The spacing of adjacent valve tappets may be particularly small if each pump cam axially overlaps both adjacent valve tappets and the axial projection of its contour is disposed entirely within the base circle of the two valve cams. That arrangement requires relatively large base diameters of the valve cams and this requirement cannot always be met in practice because it involves higher relative velocities of the parts which are in sliding contact. But the arrangement has the advantage in that the angular positions of the several cams can be freely selected.

In order to minimize the base diameter of the valve cams so that space and weight are saved, a further feature of the invention resides in that the overlapping portion of the pump cam is recessed on the return side and its full contour is disposed between the valve tappets. Whereas the pump cam has its full effective width only in part of its periphery in that case, this is not significant because the recess is disposed on the return side where the pressures are much lower.

Figure 2:
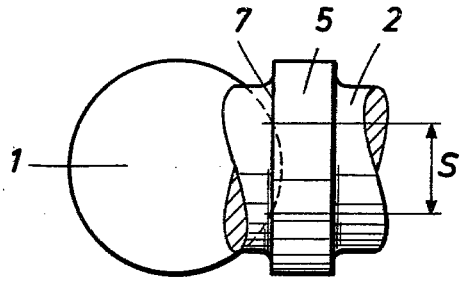
Figure 3:
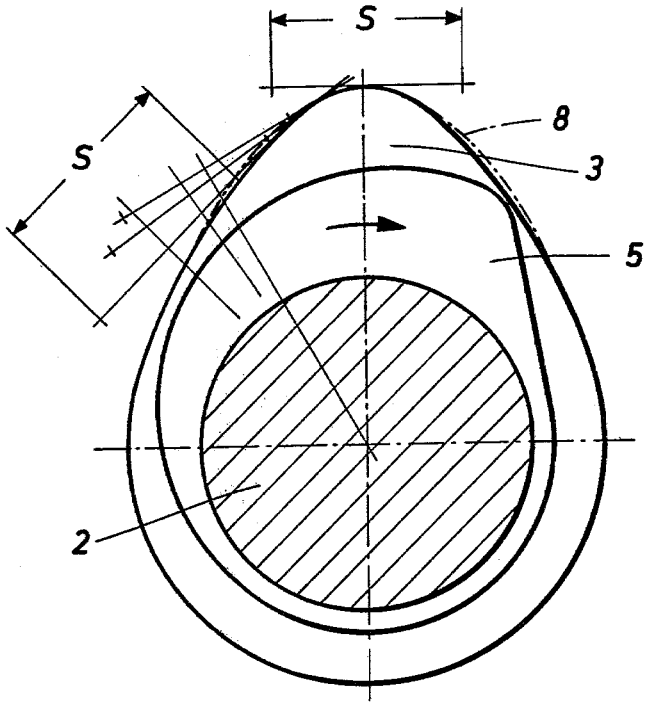
Figure 4:
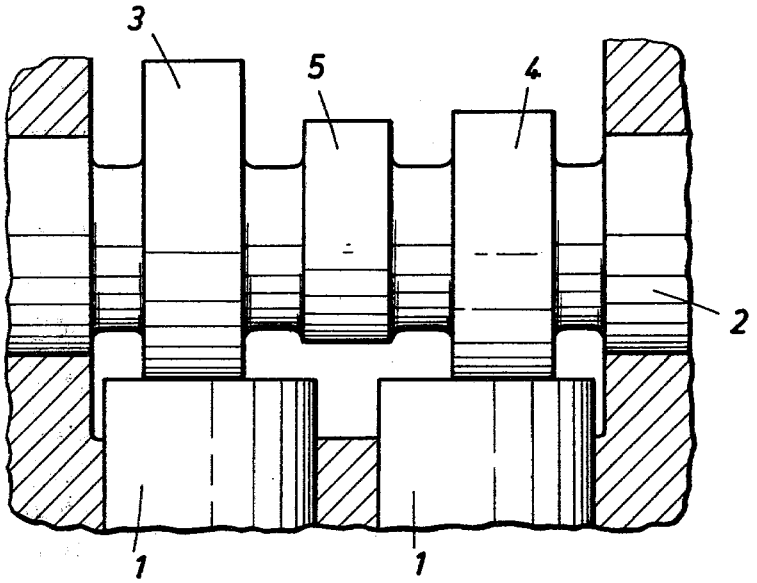
Figure 5:
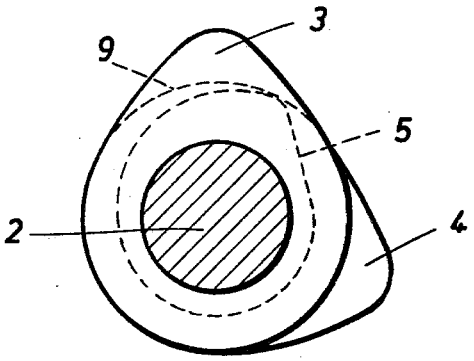
Figure 6:
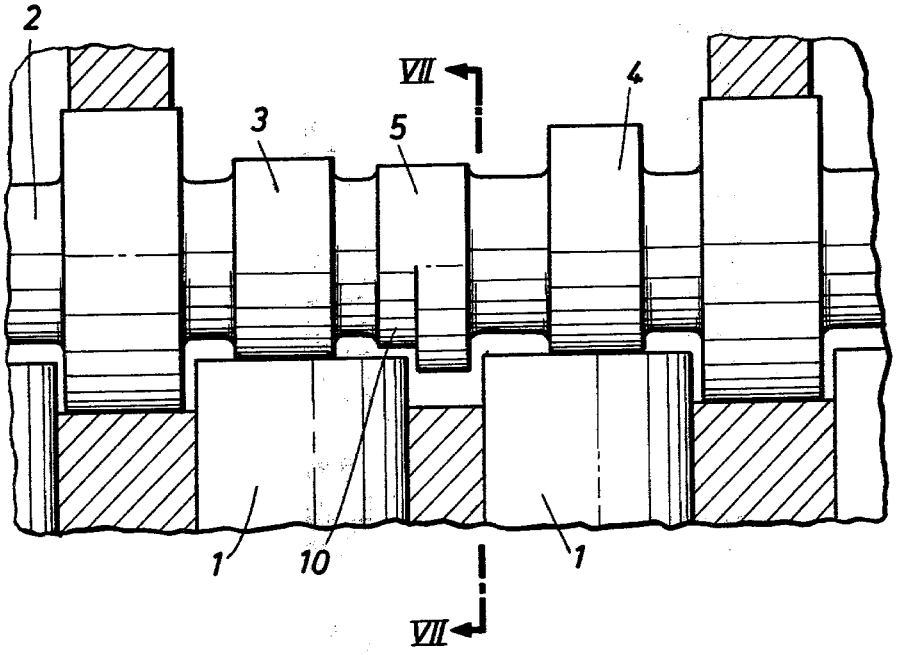
Figure 7:
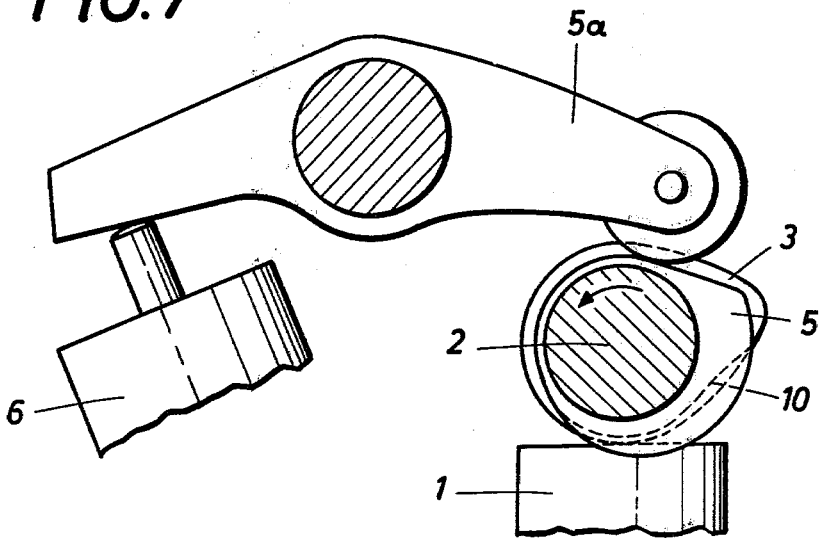

The invention is shown strictly diagrammatically and by way of example on the accompanying drawings, in which FIG. 1 is a sectional view showing part of a camshaft with the rocker lever omitted, FIG. 2 is a top plan view taken in the direction of the arrow II in FIG. 1, FIG. 3 is an enlarged view showing the cam design, FIG. 4 is a view similar to FIG. 1 showing a modification, FIG. 5 shows the cams of the modification of FIG. 4, FIG. 6 is a view which is similar to those of FIGS. 1 and 4 and shows another modification and FIG. 7 is a diagrammatic sectional view taken on line VII—VII in FIG. 6.

A camshaft 2 is provided with cams 3, 4 for actuating flat-end tappets 1 of the inlet and outlet valves of a fuel-injected engine. The camshaft 2 is provided with a pump cam 5 which is disposed between adjacent cams 3, 4 for operating the inlet and outlet valves. Cam 5 actuates or controls a fuel injection pump 6 by means of cam follower or rocker lever 5*a* (FIG. 7). In accordance with FIGS. 1 and 2, the pump cam 5 axially overlaps the valve tappet 1 disposed on the left. S designates the line of intersection between the top end face of the valve tappet 1 and the plane of the adjacent end face 7 of the pump cam 5; the latter plane is normal to the axis of the camshaft 2. During a rotation of the camshaft 2, the line of intersection S generates an envelope 8 shown in FIG. 3. The axial projection of the contour of the pump cam 5 is disposed entirely within that envelope 8 so that the pump cam 5 and the nearest valve tappet on the left cannot collide in spite of their axial overlap.

In accordance with FIGS. 4 and 5, the pump cam 5 axially overlaps both adjacent valve tappets 1 and the axial projection of its contour is disposed entirely within the base circles 9 (FIG. 5) of the two valve cams 3, 4.

In the embodiment shown in FIGS. 6 and 7, the left-hand part of the pump cam 5 is formed on the return side with a recess 10 and the pump cam 5 has its full contour only between the valve tappets 1. Because the pump cam 5 is formed with the recess 10, the two valve tappets 1 may be very closely spaced. Whereas the pump cam 5 has its full effective width only in part of its periphery, this is not significant because the recess 10 is disposed on the return side where the pressures are much lower.

What is claimed is:

1. In an internal combustion engine comprising a fuel injection pump, an engine cylinder having an inlet valve and an outlet valve, an inlet valve tappet having a planar end face, an outlet valve tappet having a planar end face, a camshaft having an axis extending parallel to the planar end faces of the tappets and a set of three axially fixed, adjacent cams associated with the cylinder, two of the cams engaging the planar end faces of the inlet valve tappet and outlet valve tappet, respectively, and a third one of the cams disposed between and axially spaced from the two cams, the third cam having an end face extending perpendicularly to the axis, and a cam follower cooperating with the third cam and operable thereby to control the fuel injection pump, the improvement of the third cam overlapping the planar end face of one of the two tappets in an axial direction to form an overlapping cam portion and another cam portion axially spaced therefrom and extending between the planar end faces of the two tappets, the overlapping cam portion having a return portion which is radially recessed relative to the other cam portion.

2. In an internal combustion engine comprising a fuel injection pump, an engine cylinder having an inlet valve and an outlet valve, an inlet valve tappet having a planar end face, an outlet valve tappet having a planar end face, a camshaft having an axis extending parallel to the planar end faces of the tappets and a set of three axially fixed, adjacent cams associated with the cylinder, two of the cams engaging the planar end faces of the inlet valve tappet and outlet valve tappet, respectively, and a third one of the cams disposed between and axially spaced from the two cams, the third cam having an end face extending perpendicularly to the axis, and a cam follower cooperating with the third cam and operable thereby to control the fuel injection pump, the improvement of the third cam overlapping at least one of the planar end faces of the two tappets in an axial direction to form an overlapping cam portion, the overlapping cam portion having a contour entirely within an envelope generated during rotation of the camshaft by a line of intersection connecting points of intersection between the planar end face of the one tappet the third cam overlaps and a projection of the end face of the third cam thereon.

3. In an internal combustion engine comprising a fuel injection pump, an engine cylinder having an inlet valve and an outlet valve, an inlet valve tappet having a planar end face, an outlet valve tappet having a planar end face, a camshaft having an axis extending parallel to the planar end faces of the tappets and a set of three axially fixed, adjacent cams associated with the cylinder, two of the cams engaging the planar end faces of the inlet valve tappet and outlet valve tappet, respectively, and a third one of the cams disposed between and axially spaced from the two cams, the third cam having an end face extending perpendicularly to the axis, and a cam follower cooperating with the third cam and operable thereby to control the fuel injection pump, the improvement of the third cam overlapping the two tappets in an axial direction, the two cams having a circular contour and the third cam having a contour entirely within the circular contours of the two cams.

* * * * *